US007887906B2

(12) United States Patent
Ohkubo et al.

(10) Patent No.: US 7,887,906 B2
(45) Date of Patent: Feb. 15, 2011

(54) ANTISTATIC AGENT, ANTISTATIC FILM AND PRODUCT COATED WITH ANTISTATIC FILM

(75) Inventors: Takashi Ohkubo, Chiba (JP); Yoshihiro Saida, Nagano (JP); Shuichi Naijo, Chiba (JP)

(73) Assignee: Showa Denko K.K., Tokyo (JP)

( * ) Notice: Subject to any disclaimer, the term of this patent is extended or adjusted under 35 U.S.C. 154(b) by 809 days.

(21) Appl. No.: 11/659,882

(22) PCT Filed: Aug. 5, 2005

(86) PCT No.: PCT/JP2005/014802

§ 371 (c)(1),
(2), (4) Date: Sep. 24, 2007

(87) PCT Pub. No.: WO2006/016670

PCT Pub. Date: Feb. 16, 2006

(65) Prior Publication Data

US 2008/0193730 A1 Aug. 14, 2008

Related U.S. Application Data

(60) Provisional application No. 60/600,777, filed on Aug. 12, 2004.

(30) Foreign Application Priority Data

Aug. 9, 2004 (JP) ..... 2004-231759

(51) Int. Cl.
*H01B 1/12* (2006.01)

(52) U.S. Cl. ..... 428/220; 252/500

(58) Field of Classification Search ..... 428/220
See application file for complete search history.

(56) References Cited

U.S. PATENT DOCUMENTS

| | | | | | |
|---|---|---|---|---|---|
| 5,641,859 | A * | 6/1997 | Chen et al. | ..... | 528/422 |
| 5,648,453 | A * | 7/1997 | Saida et al. | ..... | 528/380 |
| 5,681,659 | A * | 10/1997 | Shi et al. | ..... | 428/480 |
| 5,688,873 | A * | 11/1997 | Saida et al. | ..... | 525/410 |
| 5,871,672 | A | 2/1999 | Murphy et al. | | |
| 6,024,895 | A * | 2/2000 | Shimizu et al. | ..... | 252/500 |
| 6,162,596 | A * | 12/2000 | Schwark et al. | ..... | 430/529 |
| 2003/0062510 | A1 * | 4/2003 | Van den Bogaert | ..... | 252/500 |
| 2003/0091862 | A1 * | 5/2003 | Tokito et al. | ..... | 428/690 |

FOREIGN PATENT DOCUMENTS

| | | | |
|---|---|---|---|
| EP | 1 324 124 | A1 | 7/2003 |
| JP | 2-189333 | A | 7/1990 |
| JP | 7-48436 | A | 2/1995 |
| JP | 10168328 | A * | 6/1998 |
| JP | 11-185523 | A | 7/1999 |
| JP | 11-189746 | A | 7/1999 |
| JP | 11189746 | A * | 7/1999 |
| JP | 2003-29410 | A | 1/2003 |
| WO | WO 98/03499 | A1 | 1/1998 |
| WO | WO 0118888 | A1 * | 3/2001 |

OTHER PUBLICATIONS

Machine_English_Translation_JP_10168328_A, Saida, Electroconductive Polymer Composite Material, Jun. 1998, JPO, abstract.*

Machine_English_Translation_JP_11189746_A, Saida, Antistatic Treating Agent, Its Utilization and Article Coated Therewith, Jul. 1999, JPO, abstract.*

Dai Kitamoto, et al, "Functions and Potential Applications of Glycolipid Biosurfactants—From Energy-Saving Materials to Gene Delivery Carriers-", Journal of Bioscience and Bioengineering, vol. 94, No. 3 , 2002, pp. 187-201, XP008014846.

Catherine N. Mulligan, "Environmental Applications for Biosurfactants", Environmental Pollution, vol. 133, No. 2, Jan. 2005, pp. 183-198, XP004617325.

* cited by examiner

*Primary Examiner*—David R Sample
*Assistant Examiner*—Tahseen Khan
(74) *Attorney, Agent, or Firm*—Sughrue Mion, PLLC

(57) ABSTRACT

The invention relates to an antistatic agent, which comprises a water-soluble electroconductive polymer and a biosurfactant having a hydrophilic site of a molecular weight of 200 to 10,000, excellent in property of preventing film-thinning in chemically amplified resist, and an antistatic film and a coated product obtained by using the antistatic agent.

20 Claims, No Drawings

ANTISTATIC AGENT, ANTISTATIC FILM AND PRODUCT COATED WITH ANTISTATIC FILM

CROSS-REFERENCE TO RELATED APPLICATIONS

This is an application filed pursuant to 35 U.S.C. Section 111(a) with claiming the benefit of U.S. provisional application Ser. No. 60/600,777 filed Aug. 12, 2004 under the provision of 35 U.S.C. 111(b), pursuant to 35 U.S.C. Section 119(e)(1).

TECHNICAL FIELD

The present invention relates to an antistatic agent. More specifically, the present invention relates to an antistatic agent capable of effectively preventing a film thinning phenomenon in chemically amplified resist film used as material in electronic industry, an antistatic film using the antistatic agent and a product coated with the antistatic film.

BACKGROUND ART

A self-doping type electroconductive polymer is usually soluble in water and therefore, can be easily formed into an arbitrary shape or formed into a film, which characteristic enables easy production of large-area film. Moreover, such a polymer also exhibits an extremely excellent formability in electric devices which require microscopic processing and therefore has been widely used these days.

On the other hand, a chemically amplified resist has been an essential material technically common in lithography using light or charged particle radiation such as electron beam or ion beam. However, such a resist is susceptible to use environment and is known as a resist hard to handle. Especially, positive chemically amplified resist is even harder to handle, and it involves a concern over adverse effects by water-soluble coating material.

In a case where the resist is coated with a water-soluble coating material, there has been a problem that acid generated through exposure to light is neutralized by the coating material when the hydrogen ion concentration (hereinafter abbreviated as "pH") thereof falls in a certain range or that, even without exposure process, acid supplied from the coating material forms the same situation as in the case where the resist is exposed to light. Thus, since a trace amount of acid in the coating material greatly affects sensitivity of the resist, the pH value of the coating material solution is important. Such a problem occurs as film thinning phenomenon in a positive-type resist while it occurs as formation of hardly soluble layer or insoluble layer in a negative-type resist.

As methods for preventing the phenomenons, a method where pH decrease is controlled by using a buffer solution containing a weak acid and an amine (JP-A-H11-189746), a method using a composition containing a fluorinated aliphatic sulfonic acid or a fluorinated aliphatic carboxylic acid (JP-A-2003-29410) and the like have been proposed.

Also, a film of a composition containing a water-soluble electroconductive polymer, a vinyl-base polymer emulsion and a nonionic surfactant which has excellent storage stability has been disclosed (JP-A-H11-185523).

In recent years, under circumstances where resists patterned in accordance with miniaturization of the smallest circuit line width in semiconductor devices tend to easily collapse, attempts to make aspect ratio of resist pattern appropriate are being made in order to prevent the phenomenon and therefore, resist film thickness is with a tendency to be reduced. After a resist pattern has undergone developing process, the pattern is transcribed onto a substrate through dry-etching process.

In this process, the importance of dry-etching resistance of resists is growing, and since changes in resist form attributable to antistatic films have a great influence on pattern printing, the demand for maintaining performances of resists is growing keener and keener.

DISCLOSURE OF THE INVENTION

The object of the present invention is to provide an antistatic agent exhibiting an excellent property of preventing film thinning phenomenon in chemically amplified resists, an antistatic film using the antistatic agent and a product coated therewith.

As a result of intensive studies, the present inventors have found out that specific biosurfactants are adsorbed to water-soluble electroconductive polymer to thereby form a micellar structure, and that the giant micellar molecules generated therein can inhibit permeation of the polymer into chemically amplified resist. Based on the findings, the inventors have completed the present invention.

That is, the present invention comprises the following items.

1. An antistatic agent, which comprises a water-soluble electroconductive polymer and a biosurfactant having a hydrophilic site of a molecular weight of 200 to 10,000.
2. The antistatic agent according to 1, further comprising a solvent.
3. The antistatic agent according to 2, wherein the water-soluble electroconductive polymer is contained in an amount of 0.1 to 20 mass %, the biosurfactant is contained in an amount of 0.0001 to 1 mass % and the solvent is contained in an amount of 79 to 99.8 mass %.
4. The antistatic agent according to 1 or 2, further comprising an aromatic sulfonic acid substituted with an alkyl group or an alkenyl group or a salt thereof.
5. The antistatic agent according to 4, wherein the water-soluble electroconductive polymer is contained in an amount of 0.1 to 20 mass %, the biosurfactant is contained in an amount of 0.0001 to 1 mass %, the aromatic sulfonic acid substituted with an alkyl group or an alkenyl group or a salt thereof is contained in an amount of 0.0001 to 0.2 mass % and the solvent is contained in an amount of 78.8 to 99.8 mass %.
6. The antistatic agent according to 1, wherein the biosurfactant has a polypeptide structure.
7. The antistatic agent according to 6, wherein the biosurfactant includes a cyclic structure.
8. The antistatic agent according to 1, 3, 5 or 6, wherein the biosurfactant is produced by at least one bacterium selected from the group consisting of *Bacillus, Pseudomonas, Rhodococcus, Serrartia, Acinetobacter, Penicillium, Alcaligenes, Aureobacterium, Candida* and *Mycobacterium.*
9. The antistatic agent according to 1, 3, 5, 6 or 7, wherein the biosurfactant is at least one selected from the group consisting of surfactin, iturin, plipastatin, arthrofactin, serrawettin and straight-chain surfactin.
10. The antistatic agent according to 1, wherein the water-soluble electroconductive polymer is a π-conjugated electroconductive polymer having a Bronsted acid group or a salt thereof.
11. The antistatic agent according to 10, wherein the Bronsted acid group is a sulfonic acid group.

12. The antistatic agent according to 1, 10 or 11, wherein the water-soluble electroconductive polymer contains a chemical structure represented by formula (1).

(1)

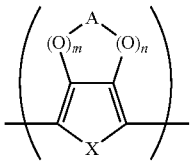

(In the formula, m and n each independently represents 0 or 1. X represents any one of S, N—$R^1$ and O, A represents an alkylene or alkenylene group (wherein two or more double bonds may be present) having 1 to 4 carbon atoms which has at least one substituent represented by —B—$SO_3^-M^+$ and may have other substituents, B represents —$(CH_2)_p$—$(O)_q$—$(CH2)_r$—, p and r each independently represents 0 or an integer of 1 to 3, and q represents 0 or 1. $M^+$ represents a hydrogen ion, an alkali metal ion or a quaternary ammonium ion.)

13. The antistatic agent according to 1, 10 or 11, wherein the water-soluble electroconductive polymer contains a chemical structure represented by formula (2).

(2)

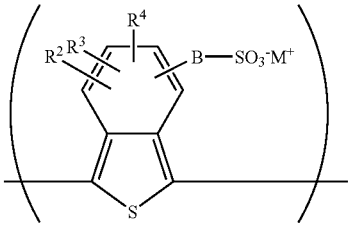

(In the formula, $R^2$ to $R^4$ each independently represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or —B—$SO_3^-M^+$ group. B, p, q, r and $M^+$ each has the same meaning as defined in 12 above.)

14. The antistatic agent according to 1, 10 or 11, wherein the water-soluble electroconductive polymer contains a chemical structure represented by formula (3).

(3)

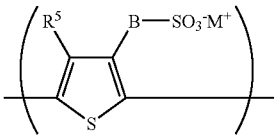

(In the formula, $R^5$ represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or —B—$SO_3^-M^+$ group. B, p, q, r and $M^+$ each has the same meaning as defined in 12 above.)

15. The antistatic agent according to 1, 10 or 11, wherein the water-soluble electroconductive polymer contains a chemical structure represented by formula (4)

(4)

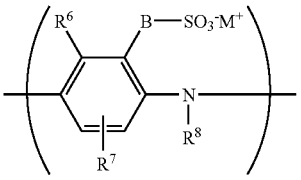

(In the formula, $R^6$ and $R^7$ each independently represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or a $SO_3^-M^+$ group. $R^8$ represents a monovalent group selected from a hydrogen atom, a linear or branched, saturated or unsaturated hydrocarbon group having 1 to 20 carbon atoms, phenyl group and a substituted phenyl group. B, p, q, r and $M^+$ each has the same meaning as defined in 12 above.)

16. The antistatic agent according to 12 or 13, wherein the water-soluble electroconductive polymer is a polymer containing 5-sulfoisothianaphthene-1,3-diyl.

17. The antistatic agent according to 1, comprising light scattering particles of a particle size of 0.05 to 10 μm.

18. The antistatic agent according to 17, wherein the particle distribution of the light scattering particles of a particle size of 0.05 to 10 μm is 50 to 99.9% based on the total particles.

19. An antistatic film obtained by using the antistatic agent described in any one of 1 to 18.

20. The antistatic film according to 19, having a film thickness of 0.1 to 50 nm.

21. A coated product obtained by coating with the antistatic film described in 19 or 20.

22. The coated product according to 21, wherein the surface to be coated is a photosensitive composition or a composition sensitive to charge particle beam which has been applied on a base substrate.

23. A pattern formation method using the antistatic film described in 19.

BEST MODE FOR CARRYING OUT THE INVENTION

The antistatic agent of the present invention is a composition which contains a water-soluble electroconductive polymer and a biosurfactant having a hydrophilic site of a molecular weight of 200 to 10,000.

Further, the composition of the present invention may be a solution which further contains a solvent. Furthermore, the solution may further contain an aromatic sulfonic acid substituted with an alkyl or alkenyl group.

When the antistatic agent of the present invention is applied onto an article and then left standing or dried, the solvent contained in the antistatic agent decreases through volatilization or the like, making the agent semisolid or solid without fluidity. The agent in such a state having no fluidity is called "antistatic material" and when the material has a film shape, it is called "antistatic film".

The term "biosurfactant" used in the present invention is a collective term for surface-active substances produced by living organisms such as microorganisms and is described in detail in "Kinouseikaimenkasseizai (Functional Surfactants)" p.p. 122-133, CMC publishing Co., Ltd.

Examples of microorganisms producing biosurfactants used in the present invention include bacteria such as *Bacillus, Pseudomonas, Rhodococcus, Serrartia, Acinetobacter, Penicillium, Alcaligenes, Aureobacterium, Candida* and *Mycobacterium*, and particularly preferred among these is *Bacillus*.

The hydrophilic site the biosurfactant used in the present invention has has a molecular weight of 200 to 10,000, preferably 500 to 5,000. If the molecular weight of the hydrophilic site is less than 200, biosurfactant permeates the resist and film thinning cannot be prevented. On the other hand, if the molecular weight exceeds 10,000, adsorption of biosurfactant to water-soluble electroconductive polymer is inhibited, which is not preferred.

In the present invention, it is preferable that the biosurfactant have a polypeptide structure, and more preferable that the polypeptide structure be a cyclic structure.

In the present invention, the hydrophilic site contained in the biosurfactant is a portion constituting a polypeptide structure consisting of amino acid residues. The polypeptide structure may be a polypeptide structure substituted with an ester of a carboxylic acid, a sulfonic acid or a phosphoric acid via a carboxylic acid group, a hydroxyl group or a sulfonic acid group.

In the present invention, the lipophilic group contained in the biosurfactant consists of lipid represented by fatty acid, unsaturated fatty acid, β-hydroxy fatty acid, steroid, terpenoid or the like.

In the present invention, examples of biosurfactant having a polypeptide structure include surfactin, iturin, plipastatin, arthrofactin, serrawettin, and straight-chain surfactin. Among these, surfactin having a cyclic polypeptide structure and iturin are preferred. One of these biosurfactants may be used singly or a mixture of two or more of them may be used.

In the present invention, the biosurfactant is adsorbed to the later described water-soluble electroconductive polymer to form a micellar structure, and the water-soluble electroconductive polymer forms light scattering particles apparently large. Thus, permeation of the water-soluble electroconductive polymer into chemically amplified resist is inhibited, to thereby control film thinning and fogging of the resist.

In the present invention, it is preferable that the light scattering particle contained in the antistatic agent have a particle size of 0.05 to 10 μm. Particularly, in a case where the agent is applied onto a chemically amplified resist, in order to obtain performance as desired, when charged particle beam is irradiated, the charged particle beam must penetrate through the antistatically-treated film to reach the resist. Therefore, it is preferable that the particle size distribution of the particles of a particle size of 0.05 to 10 μm be 50 to 99.9%.

For the purpose of generating the light scattering particles, it is preferable that the addition amount of the biosurfactant be 0.001 to 10 times by mass based on the water-soluble electroconductive polymer. In order to generate light scattering particles of large size, it is preferable that the addition ratio be 0.1 times by mass or more.

In order for the biosurfactant to be adsorbed to the water-soluble electroconductive polymer to cover the surface of the polymer, the biosurfactant concentration required depends on the chemical structure of the water-soluble electroconductive polymer and cannot be flatly defined, however, the preferred concentration is usually 0.1 to 10,000 ppm, and particularly preferred is a concentration of 1 to 1,000 ppm.

In a case where light scattering particles with a large size may exist without any problem, it is preferable that the biosurfactant concentration be in a range of 1,000 to 10,000 ppm.

In the present invention, solubility of the biosurfactant in the solvent is greatly influenced by the pH, and the solubility can be particularly high in a pH range of from mild acid, and neutral to weakly basic so that a desired concentration may be prepared in such a pH region. In the present invention, the preferable pH value of the antistatic agent is from 2 to 11, particularly preferably 3 to 7 in consideration for application to a chemically amplified resist.

In a strong acid region of less than pH 2, the biosurfactant separates out, failing to be dissolved to achieve a concentration required to exhibit its surface-action effect, so that little surface-action effect can be obtained. On the other hand, in a alkali region of more than pH 11, hydrolysis of weak bonding sites such as ester bond contained in the biosurfactant proceeds, which is not preferred.

The biosurfactant used in the present invention may be used in combination with other surfactants. By using other surfactants in combination with the biosurfactant, not only film thinning phenomenon and changes in resist shape can be inhibited, but also coatability onto the resist surface can be improved. Examples of surfactants particularly preferably used in combination with the biosurfactant include an aromatic sulfonic acid substituted with an alkyl group or alkenyl group. Examples of aromatic sulfonic acid include alkyl benzenesulfonic acid, alkyl naphthalenesulfonic acid, alkyl quinolinesulfonic acid, alkyl anthraquinone sulfonic acid and salts thereof. Examples of alkyl group include straight chain or branched octyl, nonyl, decyl, undecyl, dodecyl, tridecyl, tetradecyl, pentadecyl, hexadecyl and heptadecyl, and examples of alkenyl group include octenyl, decynyl, undecynyl, dodecynyl, tridecynyl, tetradecynyl and pentadecynyl, hexadecynyl heptadecynyl and octadecynyl.

In a case where the biosurfactant and the above aromatic sulfonic acid are used in combination, the ratio of the biosurfactant concentration/aromatic sulfonic acid concentration (hereinafter abbreviated as "M") is preferable within a range of 0.001 to 5. When M exceeds 5, film thinning phenomenon becomes prominent, and the combinational use of the surfactants is not effective for a chemically amplified resist in such a case.

In the present invention, in addition to the biosurfactant and the aromatic sulfonic acid substituted with an alkyl or alkenyl group, other surfactants may by used together.

The surfactant usable in combination is not particularly limited, however, examples of anionic surfactant include alkyl ether carboxylic acid, dialkyl sulfosuccinic acid, polyoxyethylene alkyl ether sulfuric acid ester, polyoxyethylene alkylphenylether sulfuric acid ester, higher alcohol phosphoric acid ester, higher alcohol ethylene oxide adduct phosphoric acid ester and acyl-N-methyl taurine, and in case of acid type, salts thereof may also be used.

Examples of cationic surfactant include monoalkyl ammonium chloride, dialkyl ammonium chloride, ethoxylated ammonium chloride, other specific quaternary salts, alkylamine acetate salt, diamine dioleate, and LAG/lauroylamide guanidine.

Examples of non-ionic surfactant include glycerine fatty acid ester (glyceryl stearate and glyceryl oleate), propylene glycol fatty acid ester, sorbitan fatty acid ester(sorbitan oleate, sorbitan stearate), sucrose fatty acid ester, polyethylene glycol fatty acid ester(glycol distearate), polyoxyethylene alkyl ether, alkyl glyceryl ether, polyoxyethylene alkylphenyl ether, polyoxyethylene polyoxypropylene ether, polyoxyalkylene alkyl ether, acetylene glycol, polyoxyethylene sorbitan fatty acid ester, polyoxyethylene sorbitol fatty acid ester (tetraoleic acid polyoxyethylene sorbit), alkyl glyceryl ether (isostearyl glyceryl), fatty acid alkylene oxide adduct, polyoxyethylene hardened castor oil, fatty acid alkanolamide (lauric acid diethanolamide), fatty acid amide alkylene oxide adduct, amine EO adduct, amine PO adduct, and diamine alkylene oxide adduct.

Examples of amphoteric surfactant include lauryl dimethyl amino acetic acid betaine, stearyldimethyl amino acetic acid betaine, lauryl dimethyl amine oxide, 2-alkyl N-carboxymethyl-N-hydroxyethyl imidazolinium betaine, lauric acid amide propyl betaine, lauryl hydroxy sulfobetaine, and alanine-base surfactants.

Further, other than above, various high molecular weight surfactants and high molecular weight base dispersants, phosphatide(lecithin and the like), fluorine-base surfactants and silicone-base surfactants can be used.

One of these surfactants may be used singly or a mixture of two or more kinds thereof may be used in combination.

As an example of the water-soluble electroconductive polymer used in the present invention, π-conjugated electroconductive polymer having a Bronsted acid group or a salt thereof is mentioned. The Bronsted acid group may be included by direct substitution in the π-conjugated main chain. Alternatively, the Bronsted acid group may be included by indirect substitution through a spacer(such as alkylene side chain or oxyalkylene side chain). It is not necessarily limited by the primary chemical structure.

Examples of the water-soluble electroconductive polymer include copolymers having a repeating unit such as poly (isothianaphthene sulfonic acid), poly(thiophene alkylsulfonic acid), poly(pyrrole alkylsulfonic acid), poly(aniline sulfonic acid), poly(anilinealkane sulfonic acid) or poly (anilinethioalkane sulfonic acid), and self-doping type electroconductive polymers such as salt structures and substituted derivatives of these compounds.

Moreover, in the copolymer, the repeating unit having a chemical structure with a sulfonic acid group is usually present in a range of 50 to 100 mol %, preferably 80 to 100 mol %, based on the total repeating units.

Furthermore, the copolymer used in the present invention may be a copolymer having a repeating unit constituted by other π-conjugated chemical structures and also may be a copolymer composed of 2 to 5 kinds of repeating units. Here, the term "copolymer having a repeating unit" used in the present invention is not necessarily limited to a copolymer containing the unit with continuous repetition, and as long as the desired electroconductivity based on π-conjugated main chain can be exhibited, a copolymer such as random copolymer where the repeating unit is contained irregularly or discontinuously.

The water-soluble electroconductive polymer may be either a homopolymer or a copolymer thereof.

In the present invention, examples of preferable structures of the Bronsted acid group include chemical structures represented by formulae (1)), (2), (3) and (4).

Formula (1):

(1)

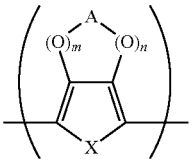

(In the formula, m and n each independently represents 0 or 1. X represents any one of S, N—$R^1$ and O, A represents an alkylene or alkenylene group having 1 to 4 carbon atoms (wherein two or more double bonds may be present) which has at least one substituent represented by —B—$SO_3^-M^+$ and may have other substituents, B represents —$(CH_2)_p$—$(O)_q$—$(CH_2)_r$—, p and r each independently represents 0 or an integer of 1 to 3, and q represents 0 or 1. $M^+$ represents a hydrogen ion, an alkali metal ion or a quaternary ammonium ion.)

The alkyl or alkenylene group may have a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group or a substituted phenyl group as a substituent.

Formula (2):

(2)

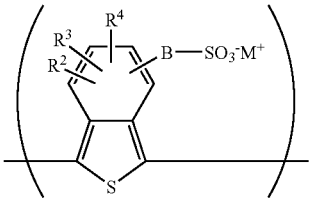

(In the formula, $R^2$ to $R^4$ each independently represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or —B—$SO_3^-M^+$ group. B represents —$(CH_2)_p$—$(O)_q$—$(CH_2)_r$—, p and r each independently represents 0 or an integer of 1 to 3, and q represents 0 or 1. $M^+$ represents a hydrogen ion, an alkali metal ion or a quaternary ammonium ion.)

In the chain of the alkyl, alkoxy, or alkyl ester group of the above $R^2$, $R^3$ and $R^4$, carbonyl bond, ether bond, ester bond, sulfonic acid ester bond, amide bond, sulfonamide bond, sulfide bond, sulfinyl bond, sulfonyl bond or imino bond may be optionally contained.

Formula (3):

(3)

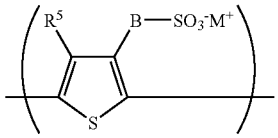

(In the formula, $R^5$ represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or —B—$SO_3^-M^+$ group. B represents —$(CH_2)_p$—$(O)_q$—$(CH_2)_r$—, p and r each independently represents 0 or an integer of 1 to 3, and q represents 0 or 1. $M^+$ represents a hydrogen ion, an alkali metal ion or a quaternary ammonium ion.)

In the chain of the alkyl, alkoxy, or alkyl ester group of the above $R^5$, carbonyl bond, ether bond, ester bond, sulfonic acid ester bond, amide bond, sulfonamide bond, sulfide bond, sulfinyl bond, sulfonyl bond or imino bond may be optionally contained.

Formula (4):

(4)

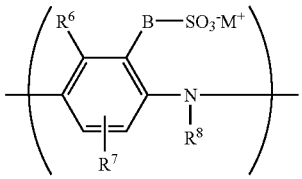

(In the formula, $R^6$ and $R^7$ each independently represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or a $SO_3^-M^+$ group. $R^8$ represents a monovalent group selected from a hydrogen atom, a linear or branched, saturated or unsaturated hydrocarbon group having 1 to 20 carbon atoms, phenyl group and a substituted phenyl group. B represents —$(CH_2)_p$—$(O)_q$—$(CH_2)_r$—, p and r each independently represents 0 or an integer of 1 to 3, and q represents 0 or 1. $M^+$ represents a hydrogen ion, an alkali metal ion or a quaternary ammonium ion.)

In the chain of the alkyl, alkoxy, or alkyl ester group of the above $R^6$ and $R^7$, carbonyl bond, ether bond, ester bond, sulfonic acid ester bond, amide bond, sulfonamide bond, sulfide bond, sulfinyl bond, sulfonyl bond or imino bond may be optionally contained.

Particularly preferred examples of $R^2$ to $R^7$ include hydrogen atom, alkyl group, alkoxy group, alkylester group, phenyl or substituted phenyl group and sulfonic acid group. Examples of these substituents include, as alkyl group, methyl, ethyl, propyl, allyl, isopropyl, butyl, 1-butenyl, pentyl, hexyl, heptyl, octyl, nonyl, decyl, undecyl, dodecyl, tetradecyl, hexadecyl, ethoxyethyl, methoxyethyl, methoxyethoxyethyl, acetonyl and phenacyl, as alkoxy group, methoxy, ethoxy, propoxy, isopropoxy, butoxy, pentyloxy, hexyloxy, octyloxy, dodecyloxy, methoxyethoxy and methoxyethoxyethoxy, as alkylester group, alkoxycarbonyl such as methoxycarbonyl, ethoxycarbonyl and butoxycarbonyl and acyloxy such as acetoxy and butyroyloxy, and as substituted phenyl group, fluorophenyl, chlorophenyl, bromophenyl, methylphenyl and methoxyphenyl.

In chains of alkyl group and alkoxy group as $R^2$ to $R^7$, carbonyl bond, ether bond, ester bond, sulfonic acid ester bond, amide bond, sulfonamide bond, sulfide bond, sulfinyl bond, sulfonyl bond or imino bond may be optionally contained.

Among the examples of $R^2$ to $R^5$ substituents in formulae (3) and (4), preferred are a hydrogen atom and a linear or branched, alkyl or alkoxy group having 1 to 20 carbon atoms, and particularly preferred are a hydrogen atom and a linear or branched alkoxy group having 1 to 20 carbon atoms.

Among the examples of substituents as $R^6$ and R7 in formula (4), preferred are hydrogen atom and monovalent group selected from linear or branched, saturated or unsaturated hydrocarbon group having 1 to 20 carbon atoms, phenyl group and substituted phenyl group.

B in formulae (1) to (4) represents —$(CH_2)_p$—$(O)_q$—$(CH_2)_r$—, wherein p and r each independently represents 0 or an integer of 1 to 3, q represents 0 or 1. In case of p=q=r=0, B represents a single bond, and —B—$SO_3^-M^+$ represents a structure where the sulfur atom of —$SO_3^-M^+$ is bonded directly to the target bonding site.

Preferred examples of B include single bond, methylene, ethylene, propylene, butylene, pentylene, hexylene, arylene, butadienylene, oxymethylene, oxyethylene, oxypropylene, methyleneoxyethylene and ethyleneoxyethylene. Particularly preferred examples of B include single bond, ethylene, propylene, oxyethylene and ethyleneoxyethylene.

$M^+$ in the formula represents a hydrogen atom, alkali metal ion or a quaternary ammonium ion, and these ions may be a mixture of two or more species thereof.

Examples of alkali metal ion include $Na^+$, $Li^+$ and $K^+$.

The quaternary ammonium ion is represented by $N(R^9)(R^{10})(R^{11})(R^{12})^+$. In the formula, each of $R^9$ to $R^{12}$ independently represents a hydrogen atom, a linear or branched, substituted or unsubstituted alkyl group having 1 to 30 carbon atoms, substituted or unsubstituted aryl group, or may represents an alkyl or aryl group which have a group containing (an) atom(s) other than carbon and hydrogen, such as alkoxy group, hydroxyl group, oxyalkylene group, thioalkylene group, azo group, azo benzene group and p-diphenyleneoxy group.

As quaternary ammonium ion, for example, an unsubstituted type or alkyl- or aryl-substituted type cation of $NH_4^+$, $NH(CH_3)_3^+$, $NH(C_6H_5)_3^+$ or $N(CH_3)_2(CH_2OH)(CH_2\text{-}Z)^+$ (provided that Z represents an arbitrary substituent of chemical formula weight of 600 or less, and examples thereof include phenoxy group, p-diphenyleneoxy group, p-alkoxydiphenyleneoxy group and p-alkoxyphenylazophenoxy group) is used. Also, in order to convert the ion into a specific cation, a conventional ion exchanger may be used.

In the chain of alkyl group as $R^9$ to $R^{12}$, there may exist carbonyl bond, ether bond, ester bond, amide bond, sulfide bond, sulfinyl bond, sulfonyl bond, imino bond and the like.

Preferred examples of chemical structure represented by formula (1), (2) or (3) include 5-(3'-propanesulfo)-4,7-dioxycyclohexa[2,3-c]thiophene-1,3-diyl, 5-(2'-ethanesulfo)-4,7-dioxycyclohexa[2,3-c]thiophene-1,3-diyl, 5-sulfoisothianaphthene-1,3-diyl, 4-sulfoisothianaphthene-1,3-diyl, 4-methyl-5-sulfoisothianaphthene-1,3-diyl,6-methyl-5-sulfoisothianaphthene-1,3-diyl, 6-methyl-4-sulfoisothianaphthene-1,3-diyl, 5-methyl-4-sulfoisothianaphthene-1,3-diyl, 6-ethyl-5-sulfoisothianaphthene-1,3-diyl, 6-propyl-5-sulfoisothianaphthene-1,3-diyl, 6-butyl-5-sulfoisothianaphthene-1,3-diyl, 6-hexyl-5-sulfoisothianaphthene-1,3-diyl, 6-decyl-5-sulfoisothianaphthene-1,3-diyl, 6-methoxy-5-sulfoisothianaphthene-1,3-diyl, 6-ethoxy-5-sulfoisothianaphthene-1,3-diyl, 6-chloro-5-sulfoisothianaphthene-1,3-diyl, 6-bromo-5-sulfoisothianaphthene-1,3-diyl, 6-trifluoromethyl-5-sulfoisothianaphthene-1,3-diyl, 5-(sulfomethane) isothianaphthene-1,3-diyl, 5-(2'-sulfoethane) isothianaphthene-1,3-diyl, 5-(2'-sulfoethoxy) isothianaphthene-1,3-diyl, 5-(2'-(2"-sulfoethoxy)methane)-isothianaphthene-1,3-diyl and 5-(2'-(2"-sulfoethoxy) ethane)-isothianaphthene-1,3-diyl, and lithium salt, sodium salt, ammonium salt, methylammonium salt, ethylammonium salt, dimethylammonium salt, diethylammonium salt, trimethylammonium salt, triethylammonium salt, tetramethylammonium salt and tetraethylammonium salt thereof.

Preferred examples of chemical structure represented by formula (4) include 2-sulfo-1,4-iminophenylene, 3-methyl-2-sulfo-1,4-iminophenylene, 5-methyl-2-sulfo-1,4-iminophenylene, 6-methyl-2-sulfo-1,4-iminophenylene,5-ethyl-2-sulfo-1,4-iminophenylene, 5-hexyl-2-sulfo-1,4-iminophenylene, 3-methoxy-2-sulfo-1,4-iminophenylene, 5-methoxy-2-sulfo-1,4-iminophenylene, 6-methoxy-2-sulfo-1,4-iminophenylene, 5-ethoxy-2-sulfo-1,4-iminophenylene, 2-sulfo-N-methyl-1,4-iminophenylene and 2-sulfo-N-ethyl-1,4-iminophenylene, and lithium salt, sodium salt, ammonium salt, methylammonium salt, ethylammonium salt, dimethylammonium salt, diethylammonium salt, trimethylammonium salt, triethylammonium salt, tetramethylammonium salt and tetraethylammonium salt thereof.

Further, examples of the water-soluble electroconductive polymer used in the present invention other than the above formulae (1) to (4), poly(carbazole-N-alkanesulfonic acid), poly(phenylene-oxyalkanesulfonic acid), poly(phenylenevinylene-alkanesulfonic acid), poly(phenylenevinylene-oxyalkanesulfonic acid), poly(aniline-N-alkanesulfonic acid), poly(thiophenealkylcarboxylic acid), poly(thiophenenoxyalkylcarboxylic acid), poly(polypyrrolealkylcarboxylic acid), poly(pyrroleoxyalkylcarboxylic acid), poly(carbazole-N-alkylcarboxylic acid), poly(phenylene-oxyalkylcarboxylic acid), poly(phenylenevinylene-alkylcarboxylic acid), poly(phenylenevinylene-oxyalkylcarboxylic acid), poly (aniline-N-alkylcarboxylic acid) and substituted derivatives thereof, 6-sulfonaphtho[2,3-c]thiophene-1,3-diyl and lithium salt, sodium salt, ammonium salt, methylammonium salt, ethylammonium salt, dimethylammonium salt, diethylammonium salt, trimethylammonium salt, triethylammonium salt, tetramethylammonium salt and tetraethylammonium salt thereof.

The molecular weight of the water-soluble electroconductive polymer used in the present invention is, if expressed in terms of the number of repeating units constituting the main chain (polymerization degree), usually from 5 to 2000, preferably from 10 to 1000.

Particularly preferable examples of the water-soluble electroconductive polymer used in the present invention include polymer of 5-sulfoisothianaphthene-1,3-diyl, random copolymer containing 80 mol % or more of 5-sulfoisothianaphthene, poly(5-sulfoisothianaphthene-1,3-diyl-co-isothianaphthene-1,3-diyl), poly(3-(3-thienyl)ethanesulfonic acid)), poly(3-(3-thienyl)propanesulfonic acid)), poly(2-(3-thienyl)oxyethanesulfonic acid)), random copolymer containing 50 mol % or more of 2-sulfo-1,4-iminophenylene, poly(2-sulfo-1,4-iminophenylene-co-1,4-iminophenylene) and lithium salt, sodium salt, ammonium salt and triethylammonium salt thereof.

The concentration of the water-soluble electroconductive polymer in the present invention depends on the antistatic performance of the film as desired. However, it is usually from 0.001 to 30 mass %, preferably from 0.01 to 10 mass %.

Further, in the antistatic agent of the present invention, solvent which is miscible with water and can dissolve water-soluble electroconductive polymer without dedoping it may be used. Examples of the solvent include ethers such as 1,4-dioxane and tetrahydrofuran, carbonates such as dimethyl carbonate, diethyl carbonate, ethylene carbonate and propylene carbonate, nitrites such as acetonitrile and benzonitrile, alcohols such as methanol, ethanol, propanol and isopropanol, aprotic solvents such as N,N-dimethylformamide, dimethylsulfoxide and N-methyl-2-pyrrolidone, inorganic acids such as sulfuric acid and organic acids such as acetic acid. One of these solvents may be used singly or a mixture solvent of two or more of them may be used.

As a preferable example of the composition of the antistatic agent of the present invention, a composition where water-soluble electroconductive polymer from 0.1 to 20 mass %, biosurfactant 0.0001 to 1 mass % and solvent from 79 to 99.8 mass % are contained is mentioned.

As an example of the antistatic agent containing other surfactants, a composition of water-soluble electroconductive polymer from 0.1 to 20 mass %, biosurfactant from 0.0001 to 1 mass %, an aromatic sulfonic acid substituted with an alkyl or alkenyl group from 0.0001 to 0.2 mass % and solvent from 78.8 to 99.8 mass % is mentioned. If the concentration of the biosurfactant is less than 0.0001 mass %, little surface-active effect is obtained while if it exceeds 1 mass %, no increase in surface-active effect commensurate with the excessive amount of the biosurfactant is obtained.

The antistatic agent of the present invention can be used with whichever of a non-chemically-amplified resist and a chemically-amplified resist.

In a non-chemically-amplified resist, the antistatic agent of the present invention is effective as antistatic treatment agent having an excellent coatability. Examples of non-chemically-amplified resist include phenol resins such as novolak resin, acrylic resins such as polymethylacrylate resin and polyacrylate resin and copolymer types of α-methylstyrene and α-chloroacrylic acid.

In a chemically amplified resist, more effective prevention of formation of a mixture layer in the contacting interface between the antistatic film and the resist is observed. Examples of chemically amplified resist include photosensitive resins such as phenol resin types, acrylic resin types and azide compound types, and resins sensitive to electrically charged particles such as polymethacrylate resin types, polyvinylphenol types, polyhydroxystyrene types and copolymer types of α-methyl styrene and α-chloroacrylic acid.

Further, additives such as photosensitizing agent, azide compound, crosslinking agent, dissolution inhibitor and acid generator may be added to the resist.

The pH of the antistatic agent of the present invention can be adjusted to an arbitrary pH value within a range of acid to alkaline by controlling the amine addition amount used for neutralizing the Bronsted acid of the water-soluble electroconductive polymer contained in the solution.

The antistatic agent of the present invention is applied onto the resist surface to form an antistatic film. As a method for coating the resist surface with the antistatic agent, spin-coating is preferably employed, however, other methods, for example, dipping method, spraying method and bar coater method may also be employed. After coating, an antistatic film is formed by air-drying at room temperature or heating the base substrate having the coated resist film on a hot plate. Also, heating treatment in inert gas atmosphere is preferable in light of removal of solvent.

After coating with the antistatic agent, in the process for forming an antistatic film on the resist film, if the resist contains residue of solvent having a high affinity with water, liquid components from the two layers permeate each other. The permeation of liquid components is accompanied by transfer of water-soluble electroconductive polymer and therefore a mixture layer is formed in the interface between the resist and the antistatic film. If the acid concentration derived from the electroconductive polymer exceeds the concentration for inducing chemical changes in the resist, it leads to film thinning phenomenon in a case where a positive-type chemically amplified resist is used.

On the other hand, in case of using a negative-type chemically amplified resist, solvent residue leads to formation of insolubilized layer and further to fogging phenomenon. Through such a chemical reaction in the interface, T-topping or bowing occurs in the resist. Such a change in the form causes line width changes or adversely affects control of etching depth and form during the process where the pattern is printed onto a substrate such as a silicon wafer.

Examples of product coated with the antistatic film of the present invention include a substrate having the antistatic film and a resist film laminated thereon. Examples of material for the substrate include silicon wafer, compound semiconductor wafers such as gallium arsenide wafer and indium phosphorus wafer, a quartz substrate and a magnetic material substrate.

Products according to the present invention include substrates which are temporarily involved in production process for semiconductor, photomask, reticle, stencil mask or the like.

Since the antistatic agent of the present invention causes no quality changes such as fogging, film thinning, and form changes including T-topping or bowing) when applied onto a chemically amplified resist to form an antistatic film, the present invention enables precise pattern formation and also the antistatic effect of the present inventor prevents positioning errors in etching step using charged particle beam.

EXAMPLES

The present invention is hereinafter explained by referring to Synthesis Examples of water-soluble polymer, Examples and Comparative Examples, however, is by no means limited by the following examples.

The measuring apparatus and measuring method employed and the resist and biosurfactant used in the following examples are as follows.

1) Measurement of pH

The pH of the aqueous solution was measured by using a hydrogen ion concentration meter with a glass electrode (pH METER F-13: manufactured by HORIBA, Ltd.).

2) Preparation Method of Coating Film Comprising the Antistatic Agent and Measurement of Its Surface Resistance Coating film of the antistatic agent was prepared by adding 2 ml of the antistatic agent onto a silicon wafer of 45 mm×45 mm square by using Spinner 1H-III (manufactured by Kyoei Semiconductor Co., Ltd.) and then spin-coating at 800 rpm.

Surface resistance of the coating film was measured by using a surface resistance meter (MEGARESTA MODEL HT-301: manufactured by SHISHIDO ELECTROSTATIC, LTD.).

3) Measurement of Resist Film Thickness

The resist film thickness was measured by using a stylus profilometer Dektak-3030(manufactured by ULVAC Inc.).

4) Measurement of Light Scattering Particles Distribution

Distribution of light scattering particles was measured by using PHOTAL FPAR-100(manufactured by OHTSUKA ELECTRONICS. CO., LTD.

5) Measurement of Contact Angle

Contact angle was measured by using a FACE CA-D (manufactured by Kyowa InterFACE Science Co., Ltd.).

6) Film Thinning in Chemically Amplified Electron Beam Resist (Hereinafter Abbreviated as "Resist")

Film thinning in resist was evaluated by the following procedures.

(1)Formation of resist film: Positive resist was spin-coated onto a silicon wafer and then solvent was removed by pre-baking (conditions were determined depending on the kind of resist used).

(2)Measurement of resist film thickness: The resist formed on the substrate was partially peeled off and the initial thickness (A) of the resist film was measured by using a stylus profilometer with the substrate surface as a reference position.

(3)Formation of antistatic film: 2 ml of antistatic treatment agent was dropped onto the coated resist surface and spin coated at 800 rpm to form an antistatic film having a film thickness of 0.02 μm.

(4)Baking treatment: A substrate having an antistatic film and resist laminated thereon was heated at 120° C. for 90 seconds and left standing still in air at room temperature for 30 minutes.

(5)Developing: 2 ml of a developing solution consisting of 2.38 mass % tetramethylanmonium hydroxide (hereinafter abbreviated as "TMAH") solution was dropped onto the antistatic film surface. After left standing still for 60 seconds, the developing solution was spun off at 800 rpm and the spinning was maintained for 60 seconds to dry the surface.

(6)Post-baking treatment: The postbaking treatment was performed by placing the substrate in an oven at 90° C. for 10 minutes to dry it.

(7)With respect to the portion where the film was peeled off in above (2), resist film thickness (B) after developed was measured by using a stylus profilometer.

(8) By subtracting the above value B from the above value, film thinning amount (C) in the resist was calculated. (C=A−B)

7) Reference Value of Film Thinning Amount

With respect to resists, there is a film thinning amount (D) specific to each kind of resist and depending on the length of storage time after formation of the resist coating film. The amount (D) of film thinning which the antistatic film is not responsible for was measured in advance by the following procedures.

(1) Formation of resist film: Positive resist was spin-coated onto a silicon wafer and then solvent was removed by pre-baking (conditions were determined depending on the kind of resist used).

(2)Measurement of resist film thickness: The resist formed on the substrate was partially peeled off and the initial thickness (E) of the resist film was measured by using a stylus profilometer with the substrate surface as a reference position.

(3) Developing: 2 ml of a developing solution consisting of 2.38 mass % TMAH solution was dropped onto the resist surface. After left standing still for 60 seconds, the developing solution was spun off at 800 rpm and the spinning was maintained for 60 seconds to dry the surface.

(4) Post-baking treatment: The postbaking treatment was performed by placing the substrate in an oven at 90° C. for 10 minutes to dry it completely.

(5) With respect to the portion where the film was peeled off in above (2), resist film thickness (F) after developed was measured by using a stylus profilometer.

(6) By subtracting the above value E from the above value F, film thinning amount (D) in the resist was calculated. (D=F−E)

8) The Resist Used and the Reference Film Thinning Amount (D)

In Examples 1 to 8 and Comparative Example 1, a positive chemically amplified resist, FEP171 (manufactured by FUJIFILM Arch Co., Ltd.) was used as resist. 0.5 ml of the resist was dropped onto a silicon wafer surface and spin-coated at 800 rpm, and then heated for 90 seconds on a hot plate heated in advance to 120° C. to thereby form a resist film and the reference film thinning amount (D) of the resist was 13 nm.

In the present invention, it is preferable that the value obtained by the equation "film thinning amount(C)-reference film thinning amount (D)" be less than 10 nm, more preferably less than 3 nm.

9) Measurement of Contact Angle of Antistatic Agent Solution Drop

In order to evaluate coatability of the antistatic agent for the surface of the resist film formed on the silicon wafer, the contact angle was measured. The contact angle was measured by forming a liquid drop of the antistatic agent having a diameter of about 30 μm at the end of an injection needle and contacting the drop onto the resist film surface to be adsorbed, and detecting the contact angle by placing a tangent line to the liquid drop surface 20 seconds after the adsorption.

10) Biosurfactants Used

As biosurfactants, sodium surfactin (registered trademark AMINOFECT) produced by SHOWA DENKO K.K. and iturin were used. Aminofect is a polypeptide where as a hydrophilic site, amino acid residues of L-glutamic acid-L-leucine-D-luecine-L-valine-L-asparatic acid-D-leucine-L-leucine, a carboxylic acid group of β-hydroxy fatty acid and an amino acid group of the glutamic acid are condensed, and also a hydroxyl group of β-hydroxy fatty acid and a carboxylic acid group of the leucine are condensed to form a cyclic structure. The lipophilic group is dodecyl group.

Iturin is a polypeptide where amino acid residues of L-asparagine-D-tyrosine-L-asparagine-L-glutamine-L-proline-D-asparagine-L-serine-β-alanine are condensed to form a cyclic structure. The lipophilic group is one compound selected from undecyl group, dodecyl group, tridecyl group and tetradecyl group substituted on β-alanine or a mixture of two or more of these groups.

Synthesis Example 1

Water-soluble Electroconductive Polymer

Poly(5-sulfoisothianaphthene-1,3-diyl) was synthesized according to the method described in JP-A-H7-48436.

Synthesis Example 2

Water-soluble Electroconductive Polymer

Poly(2-(3-thienyl)ethane sulfonic acoid was synthesized according to the method described in Synthetic Metals, Vol. 30, pp. 305-319(1989).

Synthesis Example 3

Water-soluble Electroconductive Polymer

Poly(3-(3-thienyl)propanesulfonic acid) was synthesized according to the method described in JP-A-H2-189333.

Synthesis Example 4

Water-soluble Electroconductive Polymer

Poly(2-(3-thienyl)oxyethanesulfonic acid was synthesized according to the method described in WO98/03499.

Synthesis Example 5

Water-soluble Electroconductive Polymer

Poly(2-sulfo-1,4-iminophenylene-co-1,4-iminophenylene)(50 mol %:50 mol %) which is a self-doping type electroconductive polymer compound, was synthesized according to the method described in Macromolecules, Vol. 29, p.p. 3950-3955(1996).

Example 1

Preparation of Antistatic Agent

To 95 ml of 0.6 mass % aqueous solution of poly(5-sulfoisothianaphthene-1,3-diyl), 2.8 g of 5 mass % aqueous solution of Aminofect (produced by SHOWA DENKO K.K.) and 1.5 ml of 1N-ammonia water were added and the mixture was stirred for 2 hours. An appropriate amount of 1N-ammonia water was further added thereto to obtain an antistatic agent having a pH value of 6.1.

In the integrated intensity of light scattering measured by using a light scattering photometer after the obtained antistatic agent was left standing still at room temperature for 3 hours, the light scattering intensity attributable to light scattering particles having a diameter of less than 0.05 μm was 26% while the light scattering intensity attributable to light scattering particles having a diameter of 0.05 to 0.5 μm was 74%. No light scattering attributable to light scattering particles having a diameter of 0.5 μm or more was observed. After the antistatic agent was left in cold storage overnight, the light scattering intensity was measured again by using a light scattering photometer. The light scattering intensity attributable to light scattering particles having a diameter of less than 0.05 μm was 23% while the light scattering intensity attributable to light scattering particles having a diameter of 0.05 to 0.5 μm was 76%, and the light scattering intensity attributable to light scattering particles having a diameter of 0.5 μm to 10 μm was 1%. By using the obtained antistatic agent, the film thinning amount and the contact angle were measured. The results are shown in Table 1.

Example 2

Preparation of Antistatic Agent

To 97 ml of 0.6 mass % aqueous solution of poly(5-sulfoisothianaphthene-1,3-diyl), 1.0 g of 5 mass % Aminofect (produced by SHOWA DENKO K.K.) and 1.5 ml of 1N-ammonia water were added, and the mixture was stirred for 2 hours. An appropriate amount of 1N-ammonia water was further added thereto to obtain an antistatic agent having a pH value of 5.0. By using the obtained antistatic agent, the film thinning amount and the contact angle were measured. The results are shown in Table 1.

Example 3

Preparation of Antistatic Agent

To 97 ml of 0.6 mass %. aqueous solution of poly(5-sulfoisothianaphthene-1,3-diyl), 0.20 g of 5 mass % Aminofect (produced by SHOWA DENKO K.K.), 0.50 g of 5 mass % aqueous solution of dodecyl benzenesulfonic acid (produced by KANTO KAGAKU) and 1.5 ml of 1N-ammonia water were added and the mixture was stirred for 2 hours. An appropriate amount of 1N-ammonia water was further added thereto to obtain an antistatic agent having a pH value of 5.0. By using the obtained antistatic agent, the film thinning amount and the contact angle were measured. The results are shown in Table 1.

Example 4

Preparation of Antistatic Agent

To 94 ml of 0.66 mass % aqueous solution of poly(5-(sulfoisothianaphthene-1,3-diyl), 2.0 g of 0.5 mass % aqueous solution of iturin (produced by SHOWA DENKO K.K.) and 1 ml of 1N-ammonia water were added, and the mixture was stirred for 2 hours. An appropriate amount of 1N-ammonia water was further added thereto to obtain an antistatic agent having a pH value of 6.0. By using the obtained antistatic agent, the film thinning amount and the contact angle were measured. The results are shown in Table 1.

Example 5

Preparation of Antistatic Agent

To 100 ml of 0.9 mass % aqueous solution of poly(3-(3-thienyl)ethanesulfonic acid), 0.20 g of 5 mass % aqueous solution of Aminofect (produced by SHOWA DENKO K.K.) and 0.50 g of 5 mass % aqueous solution of dodecyl benzenesulfonic acid (produced by KANTO KAGAKU) and 1.5 ml of 1N-ammonia water were added, and the mixture was stirred for 2 hours. An appropriate amount of 1N-ammonia water was further added thereto to obtain an antistatic agent having a pH value of 4.0. By using the obtained antistatic agent, the film thinning amount and the contact angle were measured. The results are shown in Table 1.

Example 6

Preparation of Antistatic Agent

To 100 ml of 0.9 mass % aqueous solution of poly(3-(3-thenyl)propanesulfonic acid), 0.20 g of 5 mass % aqueous solution of Aminofect (produced by SHOWA DENKO K.K.) and 0.50 g of 5 mass % aqueous solution of dodecyl benzenesulfonic acid (produced by KANTO KAGAKU) and 1.5 ml of 1N-ammonia water were added, and the mixture was stirred for 2 hours. An appropriate amount of 1N-ammonia water was further added thereto to obtain an antistatic agent having a pH value of 4.0. By using the obtained antistatic agent, the film thinning amount and the contact angle were measured. The results are shown in Table 1.

Example 7

Preparation of Antistatic Agent

To 100 ml of 0.9 mass % aqueous solution of poly(2-(3-thienyl)oxyethanesulfonic acid), 0.20 g of 5 mass % Aminofect (produced by SHOWA DENKO K.K.), 0.50 g of 5 mass % aqueous solution of dodecyl benzenesulfonic acid (produced by KANTO KAGAKU) and 1.5 ml of 1N-ammonia water were added and the mixture was stirred for 2 hours. An appropriate amount of 1N-ammonia water was further added thereto to obtain an antistatic agent of the present invention having a pH value of 4.0. By using the obtained antistatic agent, the film thinning amount and the contact angle were measured. The results are shown in Table 1.

Example 8

Preparation of Antistatic Agent

To 100 ml of 0.9 mass % aqueous solution of poly(2-sulfo-1,4-iminophenylene-co-1,4-iminophenylene)(50 mol %:50 mol %), 0.20 g of 5 mass % aqueous solution of Aminofect (produced by SHOWA DENKO K.K.), 0.50 g of 5 mass % aqueous solution of dodecyl benzenesulfonic acid (produced by KANTO KAGAKU) and 1.5 ml of 1N-ammonia water were added and the mixture was stirred for 2 hours. An appropriate amount of 1N-ammonia water was further added thereto to obtain an antistatic agent of the present invention having a pH value of 4.0. By using the obtained antistatic agent, the film thinning amount and the contact angle were measured. The results are shown in Table 1.

Comparative Example 1

Preparation of Comparative Antistatic Agent

To 95 ml of 0.6 mass % aqueous solution of poly(5-sulfoisothianaphthene-1,3-diyl), 4.0 g of 5 mass % aqueous solution of dodecyl benzenesulfonic acid (produced by KANTO KAGAKU) and 1.5 ml of 1N-ammonia water were added and the mixture was stirred for 2 hours. An appropriate amount of 1N-ammonia water was further added thereto to obtain a comparative antistatic agent having a pH value of 5.0.

In the integral intensity of light scattering measured by using a light scattering photometer after the obtained antistatic agent was left standing still at room temperature for 3 hours, the light scattering intensity attributable to light scattering particles having a diameter of less than 0.05 μm was 100% while no light scattering attributable to light scattering particles having a diameter of 0.05 μm or more was observed. Also, after the antistatic agent was left in cool storage overnight, the light scattering intensity attributable to light scattering particles having a diameter of less than 0.05 μm was 100% while no light scattering attributable to light scattering particles having a diameter of 0.05 μm or more was observed.

By using the obtained antistatic agent, the film thinning amount and the contact angle were measured. The results were shown in Table 1.

TABLE 1

| | Film thinning amount C (nm) | Film thinning amount-Reference film thinning amount (C-D) (nm) | Contact angle (degree) |
|---|---|---|---|
| Example 1 | 8 | −5 | 33 |
| Example 2 | 10 | −3 | 46 |
| Example 3 | 13 | ±0 | 28 |
| Example 4 | 15 | 2 | 51 |
| Example 5 | 18 | 5 | 33 |
| Example 6 | 19 | 6 | 31 |
| Example 7 | 19 | 6 | 30 |
| Example 8 | 20 | 7 | 31 |
| Comparative Example 1 | 30 | 17 | 31 |

INDUSTRIAL APPLICABILITY

The antistatic agent of the present invention, which can effectively inhibit film thinning, fogging or the like of resists, is useful particularly for a chemically amplified resist.

The invention claimed is:

1. An antistatic agent, which comprises a water-soluble electroconductive polymer and a biosurfactant having a hydrophilic site of a molecular weight of 200 to 10,000, and further comprising a solvent, wherein the water-soluble electroconductive polymer is contained in an amount of 0.1 to 20 mass %, the biosurfactant is contained in an amount of 0.0001 to 1 mass % and the solvent is contained in an amount of 79 to 99.8 mass %.

2. The antistatic agent according to claim 1, further comprising an aromatic sulfonic acid substituted with an alkyl group or an alkenyl group or a salt thereof.

3. The antistatic agent according to claim 1, wherein the biosurfactant has a polypeptide structure.

4. The antistatic agent according to claim 3, wherein the biosurfactant includes a cyclic structure.

5. The antistatic agent according to claim 1, wherein the biosurfactant is produced by at least one bacterium selected from the group consisting of *Bacillus, Pseudomonas, Rhodococcus, Serrartia, Acinetobacter, Penicillium, Alcaligenes, Aureobacterium, Candida* and *Mycobacterium.*

6. The antistatic agent according to claim 1, wherein the biosurfactant is at least one selected from the group consisting of surfactin, iturin, plipastatin, arthrofactin, iturin, serrawettin and straight-chain surfactin.

7. The antistatic agent according to claim 1, wherein the water-soluble electroconductive polymer is a π-conjugated electroconductive polymer having a Bronsted acid group or a salt thereof.

8. The antistatic agent according to claim 7, wherein the Bronsted acid group is a sulfonic acid group.

9. The antistatic agent according to claim 1, wherein the water-soluble electroconductive polymer contains a chemical structure represented by formula (1)

(1)

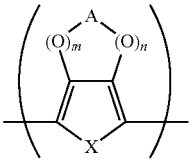

wherein m and n each independently represents 0 or 1. X represents any one of S, N—$R^1$ and O, A represents an alkylene or alkenylene group (wherein two or more double bonds may be present) having 1 to 4 carbon atoms which has at least one substituent represented by —B—$SO_3^-M^+$ and may have other substituents, B represents —$(CH_2)_p$—$(O)_q$—$(CH_2)_r$—, p and r each independently represents 0 or an integer of 1 to 3, q represents 0 or 1, and $M^+$ represents a hydrogen ion, an alkali metal ion or a quaternary ammonium ion.

10. The antistatic agent according to claim 1, wherein the water-soluble electroconductive polymer contains a chemical structure represented by formula (2)

(2)

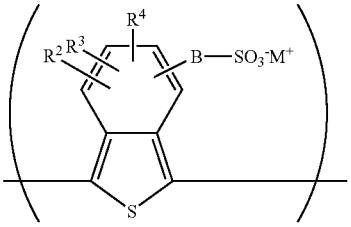

wherein $R^2$ to $R^4$ each independently represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or —B—$SO_3^-M^+$ group, B represents —$(CH_2)_p$—$(O)_q$—$(CH_2)_r$—, p and r each independently represents 0 or an integer of 1 to 3, q represents 0 or 1, and $M^+$ represents a hydrogen ion, an alkali metal ion or a quaternary ammonium ion.

11. The antistatic agent according to claim 1, wherein the water-soluble electroconductive polymer contains a chemical structure represented by formula (3)

(3)

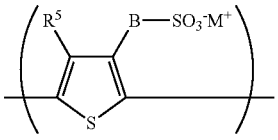

wherein $R^5$ represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or —B—$SO_3^-M^+$ group, B represents —$(CH_2)_p$—$(O)_q$—$(CH_2)_r$—, p and r each independently represents 0 or an integer of 1 to 3, q represents 0 or 1, and $M^+$ represents a hydrogen ion, an alkali metal ion or a quaternary ammonium ion.

12. The antistatic agent according to claim 1, wherein the water-soluble electroconductive polymer contains a chemical structure represented by formula (4)

(4)

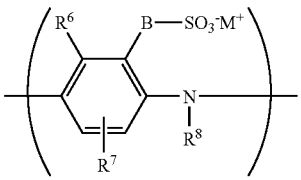

wherein $R^6$ and $R^7$ each independently represents a hydrogen atom, a linear or branched, saturated or unsaturated hydrocarbon group having 1 to 20 carbon atoms, a linear or branched, saturated or unsaturated alkoxy group having 1 to 20 carbon atoms, a hydroxyl group, a halogen atom, a nitro group, a cyano group, a trihalomethyl group, a phenyl group, a substituted phenyl group or a $SO_3^-M^+$ group, $R^8$ represents a monovalent group selected from a hydrogen atom, a linear or branched, saturated or unsaturated hydrocarbon group having 1 to 20 carbon atoms, phenyl group and a substituted phenyl group, B represents $—(CH_2)_p—(O)_q—(CH_2)_r—$, p and r each independently represents 0 or an integer of 1 to 3, q represents 0 or 1, and $M^+$ represents a hydrogen ion, an alkali metal ion or a quaternary ammonium ion.

13. The antistatic agent according to claim 9, wherein the water-soluble electroconductive polymer is a polymer containing 5-sulfoisothianaphthene-1,3-diyl.

14. The antistatic agent according to claim 1, comprising light scattering particles of a particle size of 0.05 to 10 μm.

15. The antistatic agent according to claim 14, wherein the particle distribution of the light scattering particles of a particle size of 0.05 to 10 μm is 50 to 99.9% based on the total particles.

16. An antistatic film obtained by using the antistatic agent described in claim 1.

17. The antistatic film according to claim 16, having a film thickness of 0.1 to 50 nm.

18. A coated product obtained by coating with the antistatic film described in claim 16.

19. The coated product according to claim 18, wherein the surface to be coated is a photosensitive composition or a composition sensitive to charge particle beam which has been applied on a base substrate.

20. A pattern formation method using the antistatic film described in claim 16.

* * * * *